US006220004B1

(12) United States Patent
Hsi-Chang

(10) Patent No.: US 6,220,004 B1
(45) Date of Patent: Apr. 24, 2001

(54) SWIVELED-EYE SAFETY STIRRUP WITH SHOCK-ABSORBED HINGED FOOTREST

(75) Inventor: Chang Hsi-Chang, Taichung (TW)

(73) Assignee: Eastwest International (Taiwan) Enterprises, Taichung (TW)

( * ) Notice: Subject to any disclaimer, the term of this patent is extended or adjusted under 35 U.S.C. 154(b) by 0 days.

(21) Appl. No.: 09/326,834

(22) Filed: Jun. 7, 1999

Related U.S. Application Data

(63) Continuation-in-part of application No. 09/143,169, filed on Aug. 28, 1998, now Pat. No. 6,089,004.

(51) Int. Cl.[7] ..... B68C 3/00

(52) U.S. Cl. ..... 54/48

(58) Field of Search ..... 54/47, 48, 49

(56) References Cited

U.S. PATENT DOCUMENTS

| | | | | |
|---|---|---|---|---|
| 365,238 | * | 6/1887 | Cardell | 54/48 |
| 475,127 | * | 5/1892 | De Lotbiniere | 54/48 |
| 608,605 | * | 8/1898 | House | 54/49 X |
| 726,534 | * | 4/1903 | Hollicott | 54/48 |
| 5,598,687 | * | 2/1997 | Hester | 54/47 |
| 5,979,149 | * | 11/1999 | Martin | 54/49 |

* cited by examiner

*Primary Examiner*—Robert P. Swiatek
(74) *Attorney, Agent, or Firm*—Antonio R. Durando

(57) ABSTRACT

A stirrup has a pair of arms, an eye on the arms for receiving a strap, and a footrest on the arms for supporting the foot of a rider. A cylinder/plunger assembly at each end of the footrest defines its travel between a retracted position and an extended position. A spring acting on the plunger in each cylinder urges the footrest toward the retracted position, such as to provide shock absorption for downward pressure exerted by the foot of a rider.

12 Claims, 10 Drawing Sheets

SWIVELED-EYE SAFETY STIRRUP WITH SHOCK-ABSORBED HINGED FOOTREST

RELATED APPLICATIONS

This is a continuation-in-part application of U.S. Ser. No. 09/143,169, filed on Aug. 28, 1998, and now U.S. Pat. No. 6,089,004.

BACKGROUND OF THE INVENTION

1. Field of the Invention

The invention relates to a swiveled stirrup with a flexible and shock-absorbed footrest.

2. Description of the Prior Art

A stirrup consists of a pair of curved arms which serve as a carrier for an eye and a foot. Each arm is joined to the other at one end while the opposite ends of the arms are spaced from one another to form a U-type structure. The eye is located at the joint and the foot is disposed between the spaced ends of the arms.

The stirrup is secured to a horse by passing a strap through the eye which then serves as a holding member for the strap. In a prior-art stirrup, the arms and the foot can rotate incrementally relative to the eye between a position in which the eye is coplanar with the arms and positions in which the eye is transverse to the arms. This allows the eye to be oriented optimally such that the strap rests flat against the belly of the horse and under the leg of a rider. At the same time, the arms and the foot of the sturrup can be properly positioned to receive the boot of the rider. In some prior-art embodiments, the foot of the stirrup can also rotate relative to the arms on an axis extending between the spaced ends of the arms. The foot is rotatable forwards and backwards from a central position in which a plane defined by the arms is perpendicular to the tread of the foot. The primary reason for rotation of the foot is safety. Thus, should the rider fall off the horse backwards, the foot of the stirrup can rotate backwards to allow the boot of the rider to be released more easily from the stirrup.

The stirrup described above has a drawback related to the eye. The eye has several discrete positions relative to the arms and the foot. Once the eye is moved into one of these positions to achieve an optimal initial configuration for a rider, the eye is locked to the arms and the foot by a locking mechanism. Accordingly, the eye rotates when the foot of the rider turns or twists sideways in the stirrup. As the eye rotates, the strap passing through the eye twists so that the edges of the strap are turned towards and rub against the horse and the leg of the rider. This is uncomfortable for both the horse and the rider.

Another drawback of the preceding stirrup stems from the fact that the foot of the stirrup can rotate forwards as well as backwards from the central position. During normal use, the boot of the rider tends to push forwards with a resultant forward rotation of the foot of the stirrup. This causes the rider to experience a certain degree of instability.

SUMMARY OF THE INVENTION

It is an object of the invention to reduce discomfort from a stirrup.

Another object of the invention is to improve the stability of a stirrup.

The preceding objects, as well as others which will become apparent as the description proceeds, are achieved by the invention. One aspect of the invention resides in a stirrup that comprises a carrier, a footrest on the carrier, and a holding member on the carrier for holding a strap. In one embodiment of the stirrup, the carrier and the footrest are freely rotatable relative to the holding member at least through an angle equalling or approximating 90 degrees. With this embodiment, the holding member can be positioned so that a strap held by the same lies flat against an animal to be ridden and flat against the leg of a rider. Inasmuch as during use the carrier and the footrest are free to rotate relative to the holding member at least through an angle of the order of 90 degrees, the carrier and the footrest can simultaneously be oriented to properly receive the boot of the rider. Moreover, the ability of the carrier and the footrest to freely rotate relative to the holding member allows the holding member to maintain its position in the event that the boot of the rider turns or twists sideways in the stirrup. This enables the strap to remain flat against the horse and the rider's leg.

In another embodiment of the stirrup, the carrier defines a plane and the footrest is provided with a support surface for a foot or boot. The footrest is rotatable relative to the carrier and has a preselected position in which the support surface is perpendicular to the plane. The stirrup here comprises means for restricting rotation of the footrest out of the preselected position to a single direction only.

This embodiment of the stirrup can be secured to an animal to be ridden such that the footrest can only rotate backwards from the position of perpendicularity of the carrier plane and footrest support surface. Since the footrest is unable to rotate forwards relative to the carrier, this embodiment of the stirrup enables the foot of a rider to be supported relatively stably.

Still another embodiment of the stirrup of the invention includes a cylinder/plunger assembly at each end of the footrest for allowing its travel between a retracted position and an extended position. A spring acting on the plunger in each cylinder urges the footrest toward the retracted position, such as to provide shock absorption for downward pressure exerted by the foot of a rider.

An additional aspect of the invention resides in a method of manipulating a stirrup which includes a carrier, a footrest on the carrier, and a holding member on the carrier for holding a strap. One embodiment of the method comprises the steps of engaging the holding member with a strap, and freely rotating the carrier and the footrest relative to the holding member at least through an angle equalling or approximating 90 degrees. The engaging and rotating steps are performable in either order.

It was mentioned earlier that the holding member may have a holding portion which is at least approximately coplanar with the carrier in a predetermined position of the carrier and the footrest. In such an event, the instant embodiment of the method can further comprise the step of restricting rotation of the carrier and the footrest out of the predetermined position to a single direction only. This embodiment of the method may also comprise the step of restricting rotation of the carrier and the footrest in such direction to an angle equalling or approximating 90 degrees.

As outlined previously, the footrest may be rotatable relative to the carrier. Furthermore, the carrier may define a plane and the footrest may be provided with a support surface which is intended to support a foot and is at least approximately perpendicular to the carrier plane in a preselected position of the footrest. Under such circumstances, another embodiment of the method provides for restricting rotation of the footrest out of the preselected position to a single direction only. The latter embodiment of the method can further comprise urging the footrest towards the preselected position. The features of the different embodiments of the stirrup can be combined as can the features of the different embodiments of the method.

Additional features and advantages of the invention will be forthcoming from the following detailed description of preferred embodiments when read in conjunction with the accompanying drawings.

DESCRIPTION OF THE PREFERRED EMBODIMENTS

Figure 1:
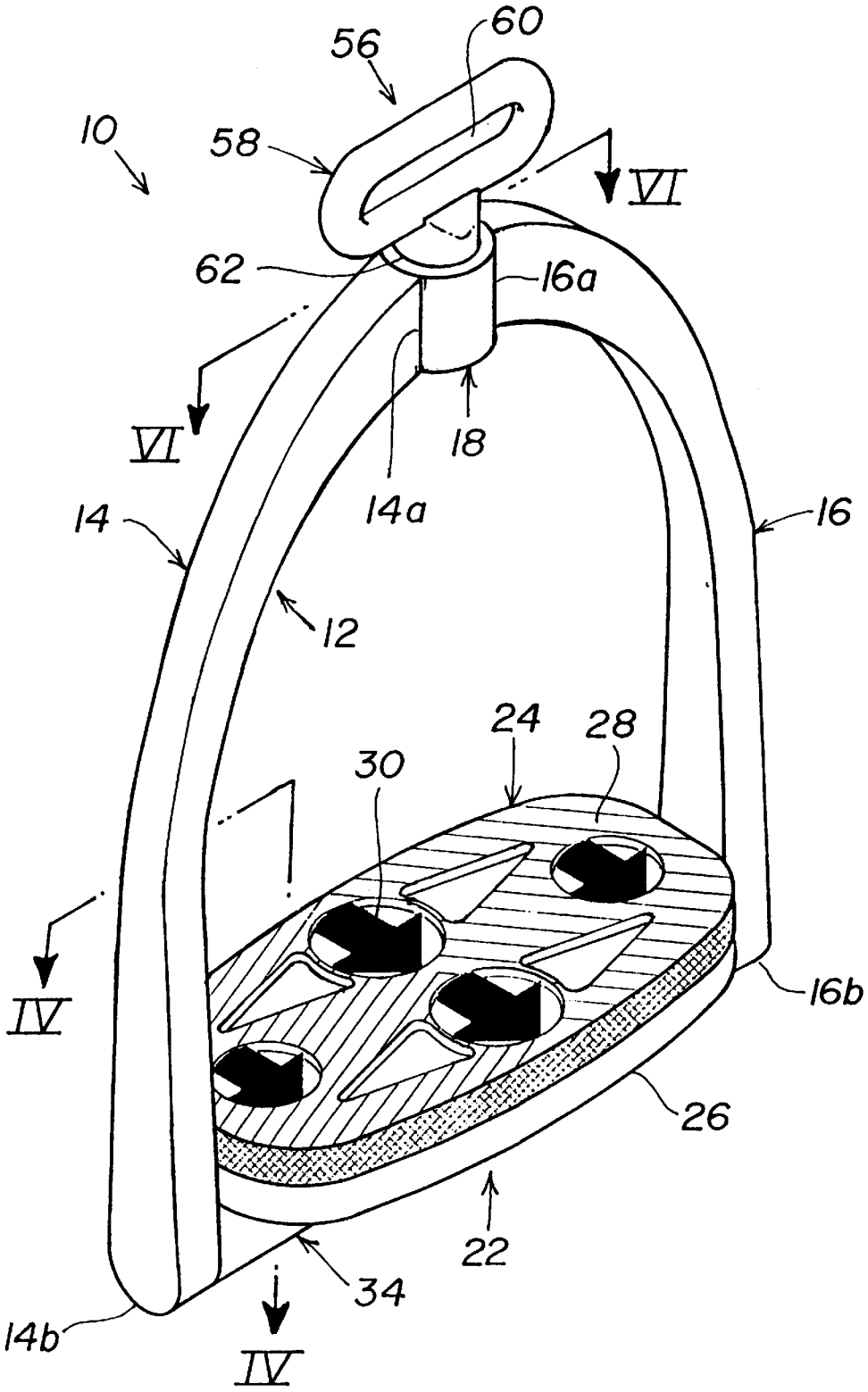
FIG. 1 is a perspective view of a stirrup in accordance with the invention in one condition.
Figure 2:
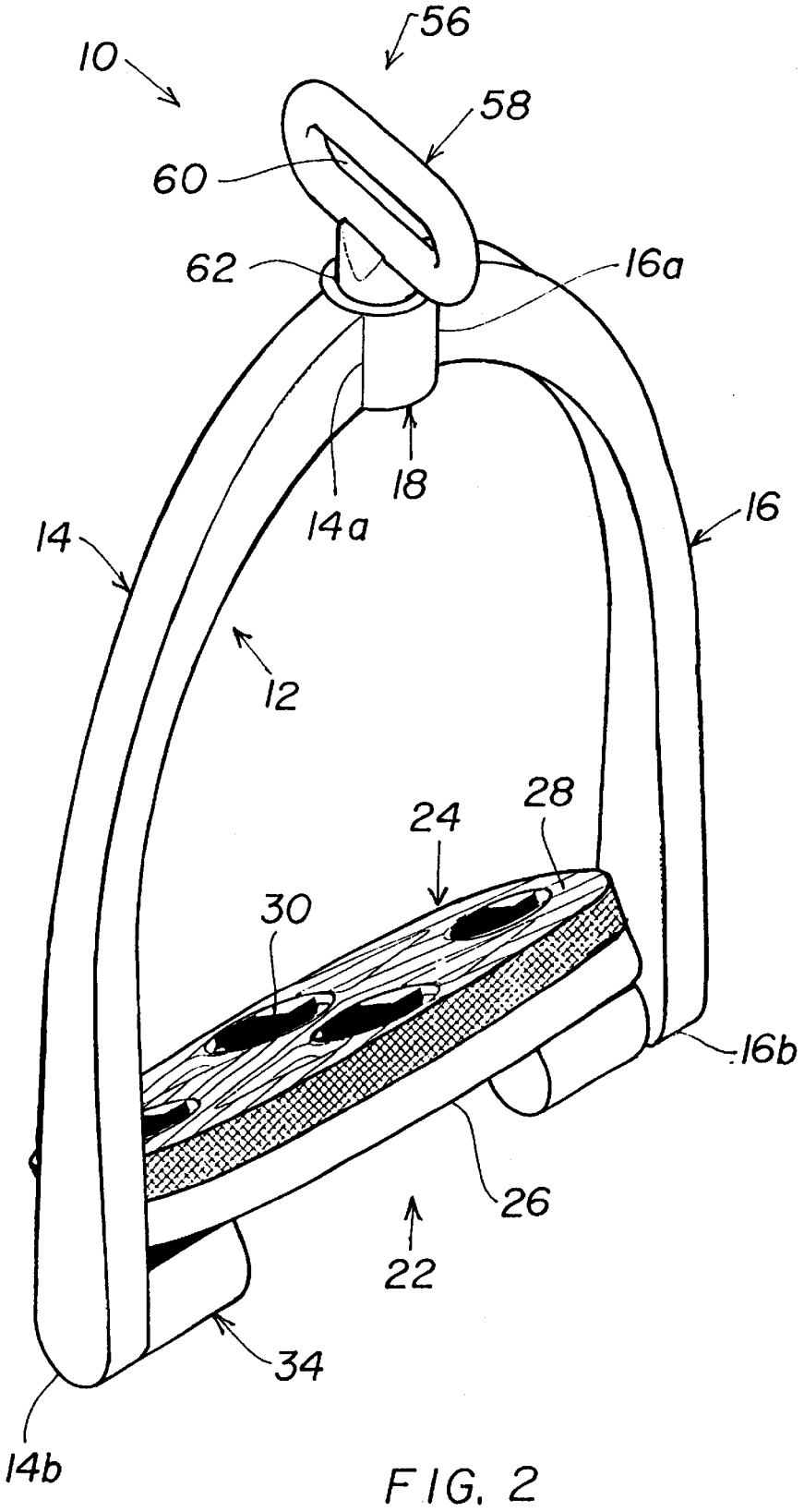
FIG. 2 is a perspective view of the stirrup of FIG. 1 in another condition.

Referring to FIGS. 1 and 2, a stirrup according to the invention is identified by the numeral 10. The stirrup 10 includes a carrier 12 made up of two curved arms 14 and 16. The arm 14 has an upper end 14*a* and a lower end 14*b* while the arm 16 has an upper end 16*a* and a lower end 16*b*. The upper end 14*a* of the arm 14 faces the upper end 16*a* of the arm 16, and the upper ends 14*a*,16*a* are connected to diametrically opposite locations of a vertical cylindrical housing 18. The upper end of the housing 18 is open whereas the lower end is closed by an end wall 20 which is visible in FIG. 6.

The lower end 14*b* of the arm 14 is spaced from the lower end 16*b* of the arm 16, and the lower ends 14*b*,16*b* face and are in line with one another. The arrangement of the arms 14,16 and housing 18 is such that the carrier 12 resembles an arch or inverted U structure which can be considered to define a plane. This plane is vertical in FIGS. 1 and 2.

A foot or footrest 22 is rotatably mounted on the lower ends 14*b*,16*b* of the arms 14,16. The foot 22 includes a resilient tread 24 which is carried by a base 26, and the tread 24 has an upper surface 28 which serves as a support surface for the foot of a rider. The upper tread surface 28 is provided with several arrows 30 which, when the stirrup 10 is in use, should point towards the front of an animal to be ridden. Accordingly, the forward direction is the direction in which the arrows 30 point while the backward direction is the opposite direction.

In FIG. 1, the position of the foot 22 is such that the plane defined by the carrier 12 is perpendicular to the upper tread surface 28. Contrary to a conventional foot which can rotate forwards and backwards from this position relative to its carrier, the foot 22 can only rotate backwards relative to the carrier 12. FIG. 2 shows the foot 22 in a rotated position relative to the carrier 12.

Figure 3:
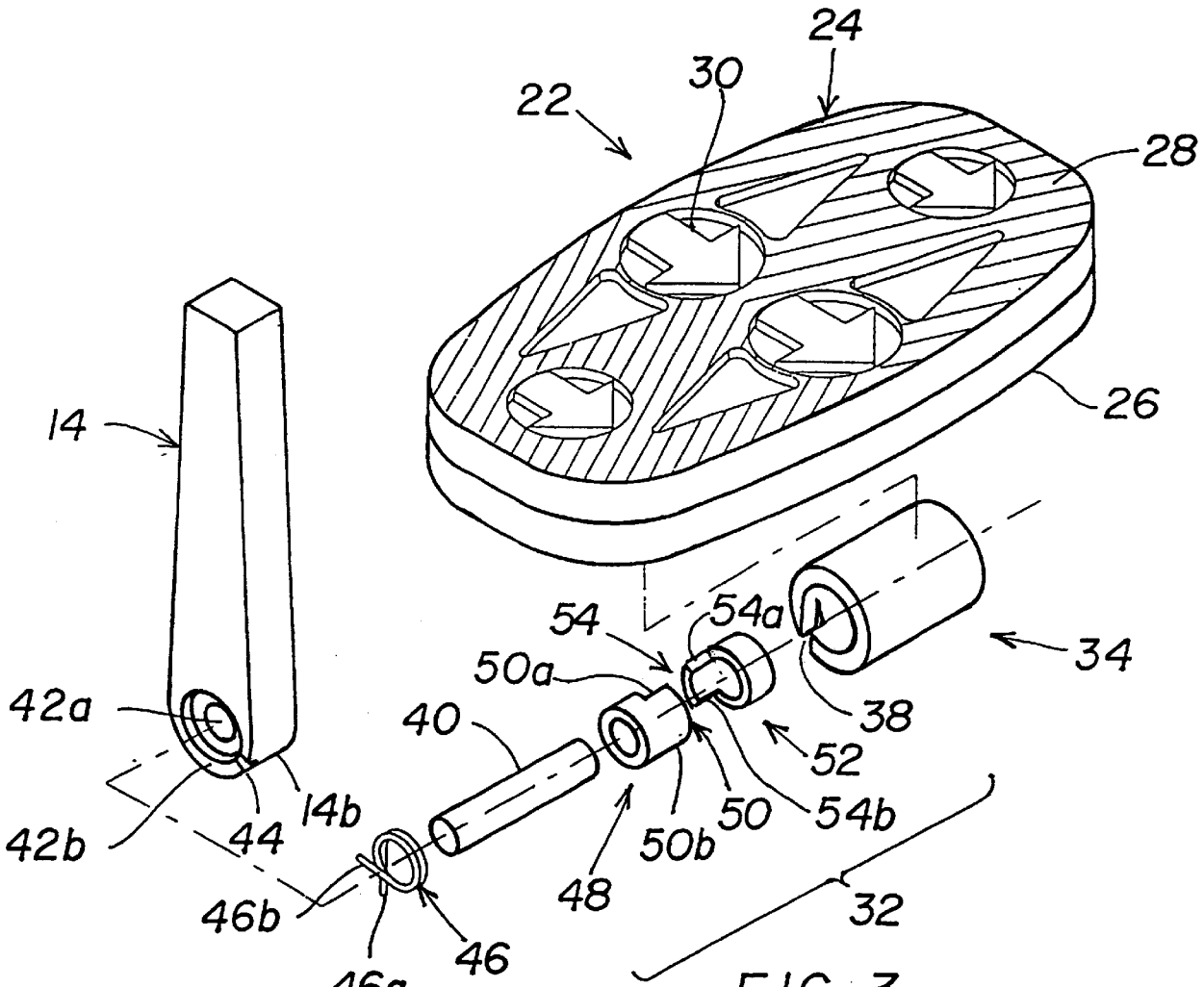
FIG. 3 is an exploded view showing the connection between a carrier and a footrest constituting part of the stirrup of FIG. 1.
Figure 4:
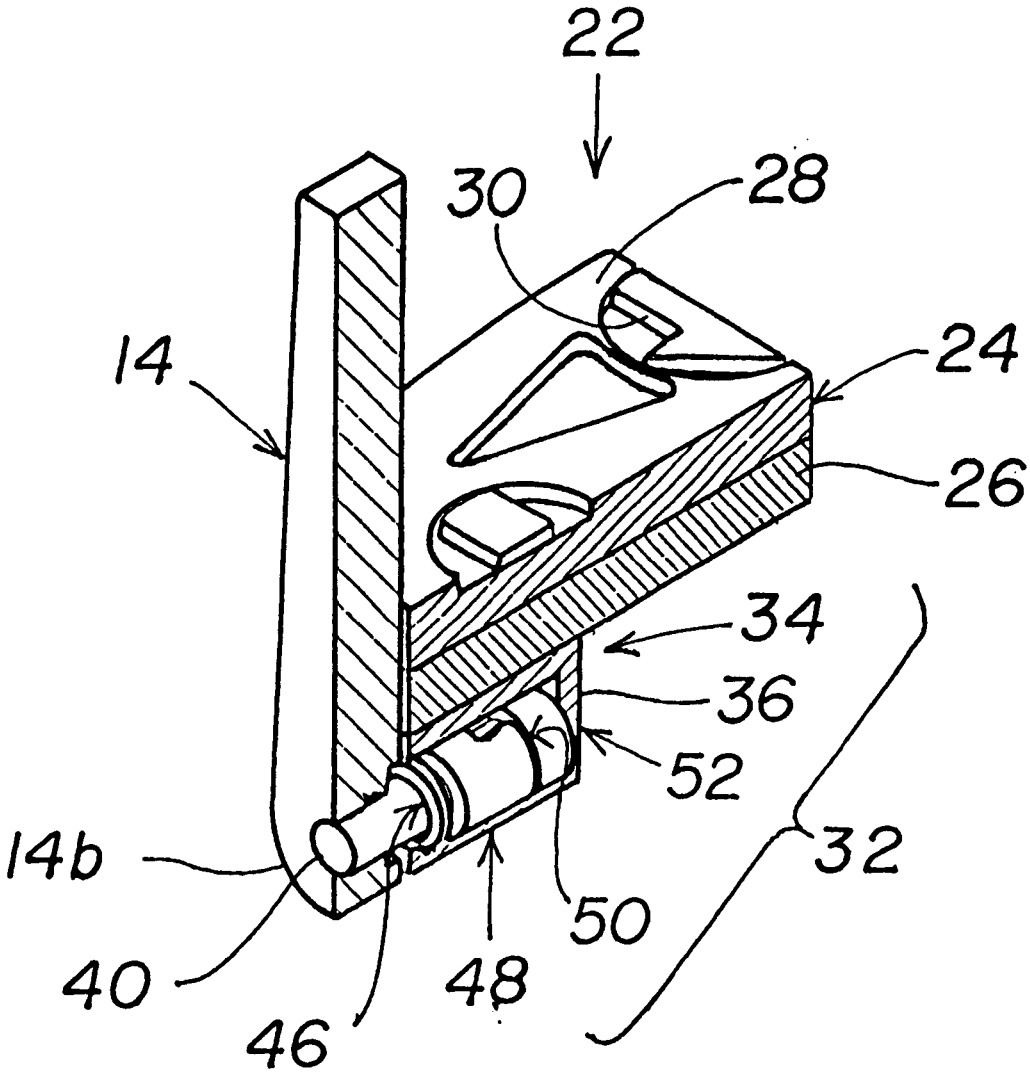
FIG. 4 is a fragmentary sectional view as seen in the direction of the arrows IV—IV of FIG. 1 and shows the connection of FIG. 3 in assembled condition.

FIGS. 3 and 4 show a connection assembly 32 between the foot 22 and the arm 14 of the carrier 12. Since the connection between the foot 22 and the arm 16 is identical, only the connection assembly 32 will be described.

The connection assembly 32 includes a horizontal cylindrical housing 34 which is affixed to the underside of the base 26 of the foot 22, e.g., by welding. One end of the housing 34 faces the arm 14 of the carrier 12 and is open while the other end faces the arm 16 and is closed by an end wall 36 (FIG. 4). The open end of the housing 34 is separated from the carrier arm 14 by a small gap. A notch or groove 38 is formed in the inner surface of the housing 34 adjacent the open end of the housing 34.

The connection assembly 32 further includes a circular shaft or rod 40 which is press fit into a narrow section 42*a* of a passage provided at the end 14*b* of the carrier arm 14. The shaft 40 projects from the passage into the housing 34. In addition to the narrow section 42*a*, the passage includes a wide section 42*b* which adjoins the narrow section 42*a*. The passage 42*a*,42*b* extends from the side of the arm 14 which faces the arm 16 towards the side of the arm 14 which faces away from the arm 16. The passage 42*a*,42*b* is open at the former side of the arm 14 and closed at the other side. The wide section 42*b* is located on the side of the arm 14 which faces the arm 16.

A notch or groove 44 extends radially outward from the wide section 42*b* of the passage 42*a*,42*b* partway to the external surface of the carrier arm 14. A torsion spring or biasing element 46 surrounds the shaft 40 with clearance and sits in the wide section 42*b*. The spring 46 has two legs 46*a* and 46*b*, and the leg 46*a* is received in the notch 44 of the carrier arm 14 while the leg 46*b* is received in the notch 38 of the housing 34 secured to the foot 22. The spring 46 bears against the carrier arm 14 and the housing 34 in a sense urging the foot 22 and the carrier 12 to the position in which the plane defined by the carrier 12 is perpendicular to the upper surface 28 of the foot 22.

A bushing 48 is located inside the housing 34 with clearance and is press fit on the shaft 40. The bushing 48, which is situated adjacent to the spring 46, is provided with an extension 50 at the end of the bushing 48 remote from the spring 46. The extension 50 constitutes a segment of a cylinder and is bounded circumferentially by a longitudinal edge 50*a* and a longitudinal edge 50*b*.

A second bushing 52 is press fit inside the housing 34 and sits between the bushing 48 and the end wall 36 of the housing 34. The bushing 52 is formed with an extension 54 at the end of the bushing 52 facing the bushing 48. The extension 54 constitutes a segment of a cylinder and is bounded circumferentially by a longitudinal edge 54*a* and a longitudinal edge 54*b*.

The bushing 52, housing 34 and foot 22 are rotatable relative to the bushing 48, shaft 40 and carrier 12.

The extension 50 of the bushing 48 and the extension 54 of the bushing 52 overlap one another. The longitudinal edge 50*a* of the extension 50 faces the longitudinal edge 54*a* of the extension 54, and the longitudinal edges 50*a*, 54*a* are arranged to abut each other when the plane defined by the carrier 12 is perpendicular to the upper surface 28 of the foot 22. Consequently, the foot 22 is unable to rotate forward relative to the carrier 12 beyond the position of perpendicularity of the upper foot surface 28 and the carrier plane.

The longitudinal edge 50*b* of the extension 50 faces the longitudinal edge 54*b* of the extension 54, and the longitudinal edges 50*b*,54*b* are spaced from one another when the carrier plane is perpendicular to the upper foot surface 28. Accordingly, the foot 22 is free to rotate backward relative to the carrier 12 from the position of perpendicularity of the upper foot surface 28 and the carrier plane. The longitudinal edges 50*b*,54*b* are arranged to come into abutment when the foot 22 has rotated backwards relative to the carrier 12 through a predetermined angle which may be selected in a conventional manner.

With reference again to FIGS. 1 and 2, an eye or holding member 56 is mounted on the carrier 12 above the housing 18. The eye 56 serves to hold a strap which is used to suspend the stirrup 10 from an animal to be ridden. The eye 56 includes an oblong portion 58 having a slot or elongated opening 60 through which a strap can be passed. The eye 56 further includes a cap-like portion 62 which extends downward from the oblong portion 58 and tapers outward on opposite sides thereof. The cap-like portion 62 is provided with a passage which is open at the end of the cap-like portion 62 remote from the oblong portion 58.

The eye 56 is rotatable relative to the carrier 12 at least through an angle of 90 degrees or approximately 90 degrees. Preferably, however, rotation of the eye 56 relative to the carrier 12 is restricted to an angle equalling or approximating 90 degrees. In the illustrated embodiment, the eye 56 and carrier 12 are rotatable relative to one another through 90 degrees between a position shown in FIG. 1 and a position shown in FIG. 2. The oblong portion 58 is coplanar with the carrier 12 in FIG. 1 and perpendicular to the carrier 12 in FIG. 2. The eye 56 can rotate freely or continuously relative to the carrier 12 between the two extreme or terminal positions, that is, there is nothing in the stirrup 10 to interfere with or retard relative movement of the eye 56 and carrier 12 from either of these positions to the other.

Figure 5:
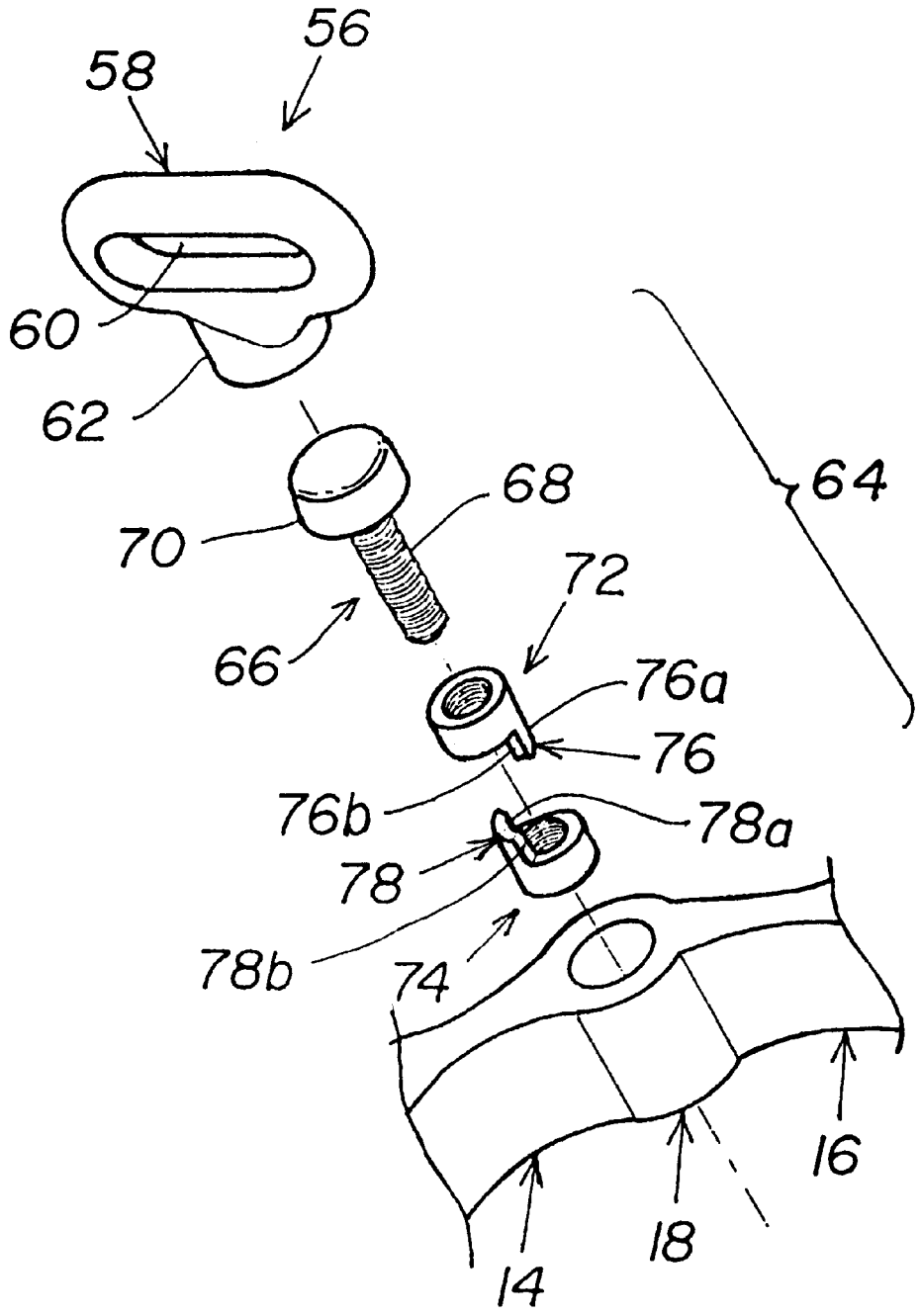
FIG. 5 is an exploded view showing the connection between the carrier of the stirrup of FIG. 1 and a strap holding member also constituting part of the stirrup.
Figure 6:
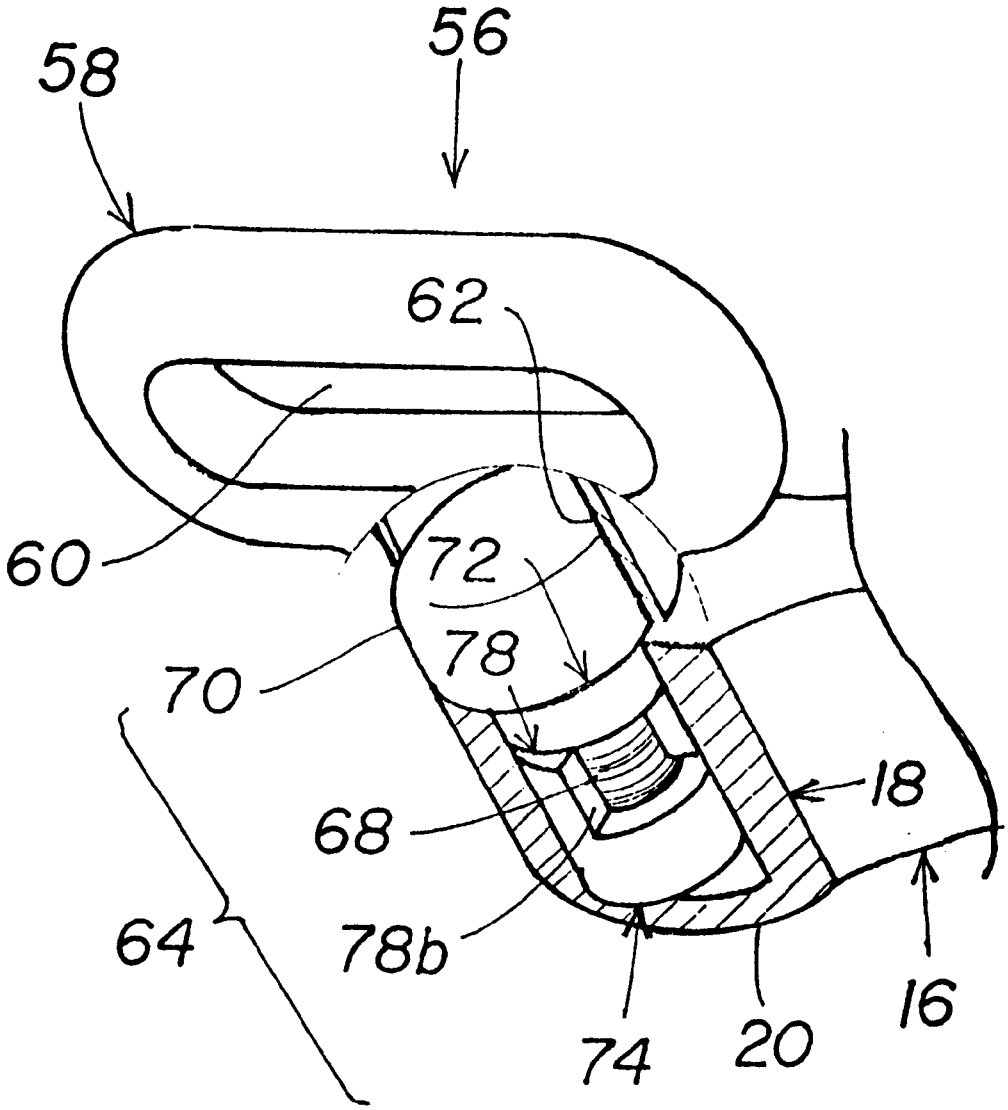
FIG. 6 is a fragmentary sectional view as seen in the direction of the arrows VI—VI of FIG. 1 and shows the connection of FIG. 5 in assembled condition.

FIGS. 5 and 6 illustrate a connection assembly 64 between the eye 56 and the carrier 12. The assembly 64 includes a screw 66 having a threaded shank 68 and a head 70 which is press fit into the cap-like portion 62 of the eye 56. The shank 68 extends into the housing 18 of the carrier 12, and the connection assembly 64 further includes a nut 72 which is screwed onto the shank 68. The nut 72 is located in the housing 18 near the open end of the same and near the head 70 of the screw 66. The connection assembly 64 also includes a nut 74 which is press fit into the housing 18 and is situated adjacent to the end wall 20 thereof. The end of the shank 68 remote from the head 70 is screwed into the nut 74.

Assuming that the eye 56 is rotated while the carrier 12 remains stationary, the screw 66 rotates together with the nut 72 adjoining the head 70 of the screw 66. On the other hand, the nut 74 adjacent to the end wall 20 of the housing 18 remains stationary and, depending upon the direction of rotation of the eye 56, the shank 68 of the screw 66 moves somewhat deeper into the nut 74 or withdraws slightly therefrom. In general, the eye 56, screw 66 and nut 72 are rotatable relative to the nut 74 and carrier 12.

The nut 72 is provided with an extension 76 at the end of the nut 72 facing the nut 74. The extension 76 constitutes a segment of a cylinder and is bounded circumferentially by a longitudinal edge 76*a* and a longitudinal edge 76*b*. Similarly, the nut 74 is formed with an extension 78 at the end of the nut 74 facing the nut 72. The extension 78 again constitutes a segment of a cylinder and is bounded circumferentially by a longitudinal edge 78*a* and a longitudinal edge 78*b*.

The extension 76 of the nut 72 and the extension 78 of the nut 74 overlap one another. The longitudinal edge 76*a* of the extension 76 faces the longitudinal edge 78*a* of the extension 78, and the longitudinal edges 76*a*,78*a* are designed to abut each other when the oblong portion 58 of the eye 56 is coplanar with the carrier 12. On the other hand, the longitudinal edge 76*b* of the extension 76 faces the longitudinal edge 78*b* of the extension 78, and the longitudinal edges 76*b*,78*b* are designed to come into abutment when the oblong portion 58 of the eye 56 is perpendicular to the carrier 12.

If the arrangement is such that the longitudinal edges 76*a*,78*a* come into abutment in response to counterclockwise rotation of the eye 56 relative to the carrier 12, no further counterclockwise rotation of the eye 56 can occur following abutment. At this time, the oblong portion 58 of the eye 56 is coplanar with the carrier 12. In this position, the longitudinal edge 76*b* of the extension 76 is spaced from the longitudinal edge 78*b* of the extension 78 so that the eye 56 is free to rotate clockwise relative to the carrier 12.

The spacing between the longitudinal edges 76*b*,78*b* is such that the longitudinal edges 76*b*,78*b* come into abutment when the eye 56 has been rotated clockwise 90 degrees relative to the carrier 12. The oblong portion 58 of the eye 56 is then perpendicular to the carrier 12. Additional clockwise rotation of the eye 56 is prevented although the eye 56 is free to rotate counterclockwise relative to the carrier 12 since the longitudinal edges 76*a*,78*a* are now spaced from one another.

Assuming that the oblong portion 58 of the eye 56 is coplanar with the carrier 12, the operation of the stirrup 10 is as follows:

The stirrup 10 is placed next to the body of an animal to be ridden with the slot 60 of the eye 56 facing the body. A free end of a strap attached to the animal is passed through the slot 60, and the free end of the strap is secured to suspend the stirrup 10 from the animal. The strap is arranged to lie flat against the animal. The carrier 12 and foot 22 are thereupon rotated to a position in which the stirrup 10 can receive the foot of a rider. In this regard, care should be exercised when positioning the stirrup 10 next to the animal so that the arrows 30 on the foot 12 point forwards following rotation of the carrier 12 and foot 22. Once the carrier 12 and foot 22 have been rotated, the rider mounts the animal and, in the process, places her or his foot or boot on the foot 22 of the stirrup 10.

If the upper surface 28 of the foot 12 is perpendicular to the carrier plane and the rider exerts backward pressure on the foot 22 while mounting or riding the animal, the foot 22 rotates backwards relative to the carrier 12 against the action of the spring 46. Upon rotation of the foot 22 relative to the carrier 12, the upper foot surface 28 is no longer perpendicular to the carrier plane. When the backward pressure is released, the spring 46 returns the foot 22 to the position of perpendicularity of the upper foot surface 28 and the carrier plane.

In contrast, should the rider exert forward pressure on the foot 22 when the upper foot surface 28 is perpendicular to the carrier plane, the foot 22 remains fixed relative to the carrier 12. Consequently, the stability of the rider is enhanced.

In the event that the foot of the rider turns or twists sideways while the eye 56 and the carrier 12 are between their terminal positions, the carrier 12 rotates with the foot of the rider. However, the eye 56 remains in position because the carrier 12 can rotate freely relative to the eye 56. Hence, the strap which passes through the eye 56 remains flat rather than twisting so that the edges thereof rub against and irritate the animal and the leg of the rider.

In the preceding description of the operation of the stirrup 10, it was assumed that the oblong portion 58 of the eye 56 was coplanar with the carrier 12 when the strap was passed through the eye 56. In this case, the carrier 12 and foot 22 are rotated to a position in which the stirrup 10 can receive the foot of the rider after passing the strap through the eye 56. Alternatively, the carrier 12 and foot 22 can be rotated to this position before passing the strap through the eye 56 and then held in such position while the strap is passed through the eye 56.

Figure 7:
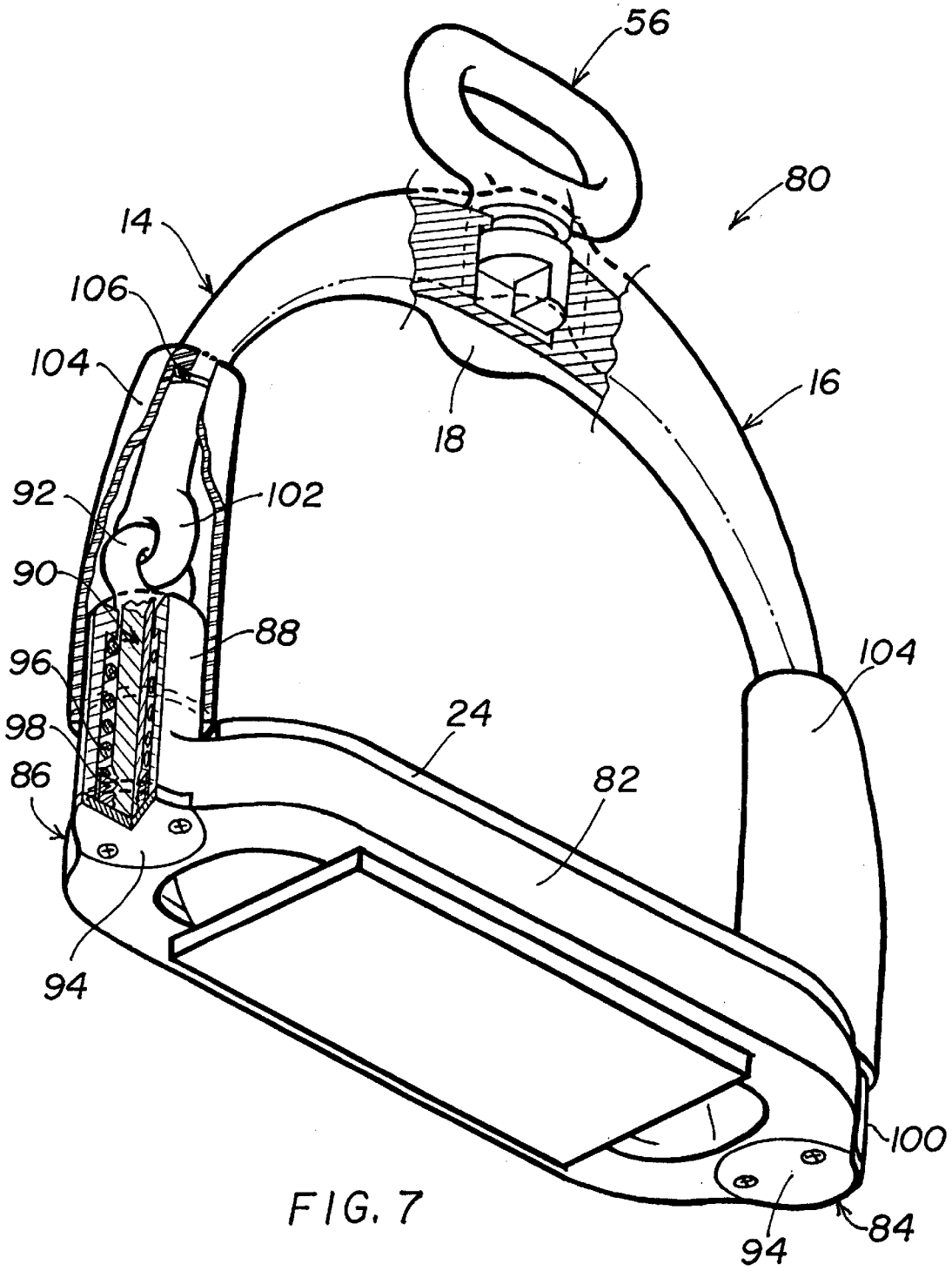
FIG. 7 is a perspective view of a stirrup in accordance with another embodiment of the invention in one condition.
Figure 8:
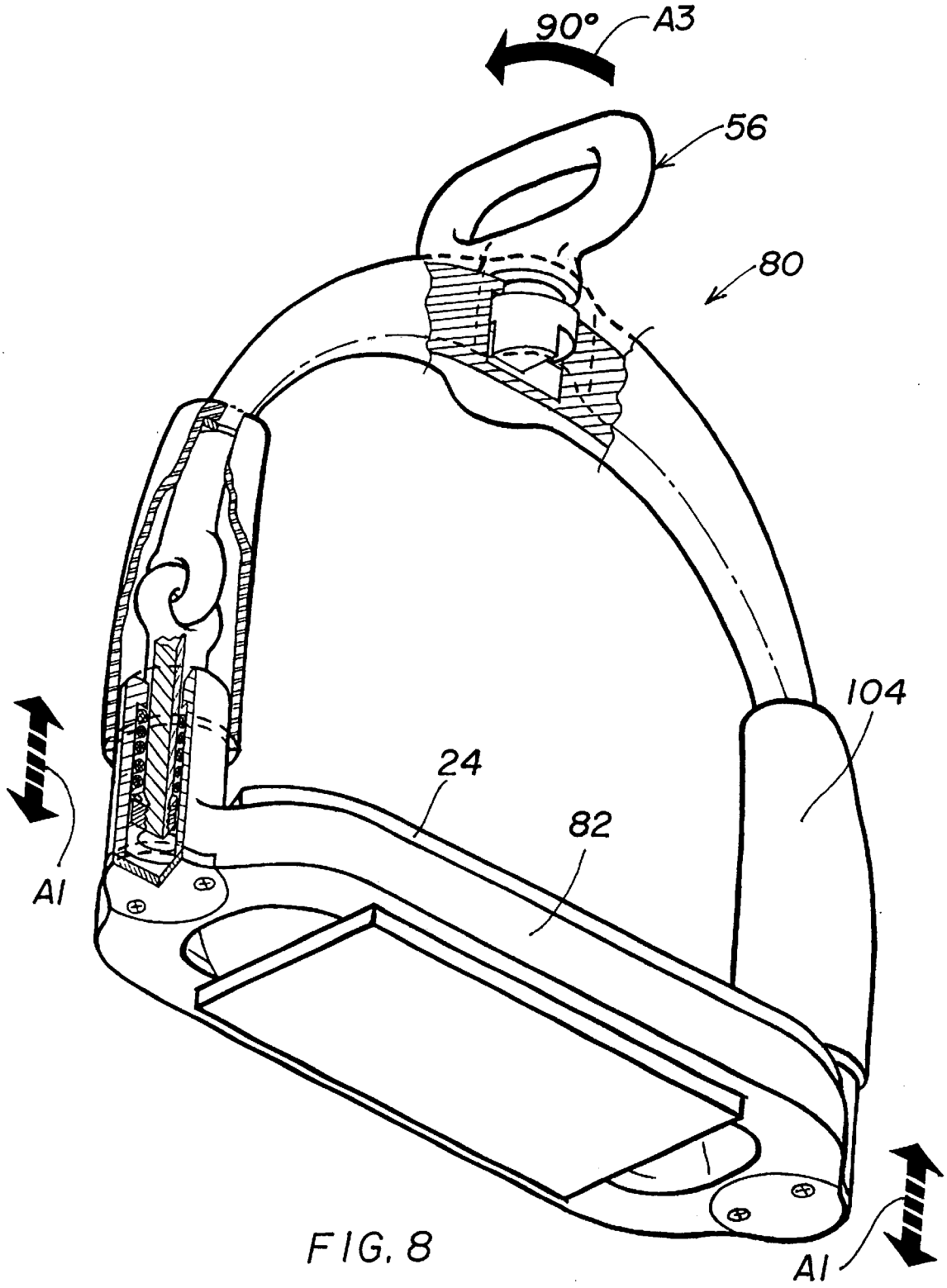
FIG. 8 is a perspective view of the stirrup of FIG. 7 in another condition.
Figure 10:
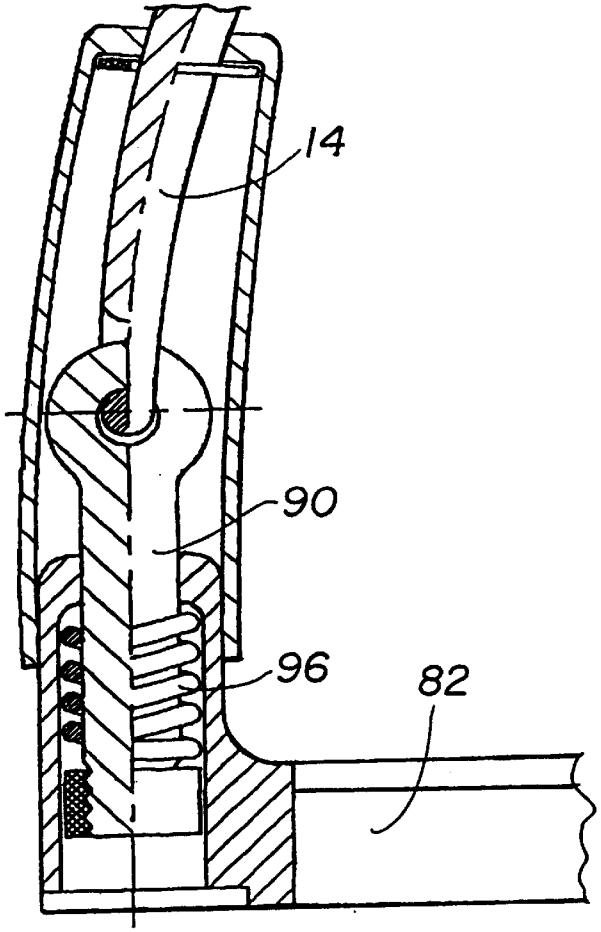
FIG. 10 is a view of the cylinder/plunger connection of FIG. 9 in extended position.
Figure 9:
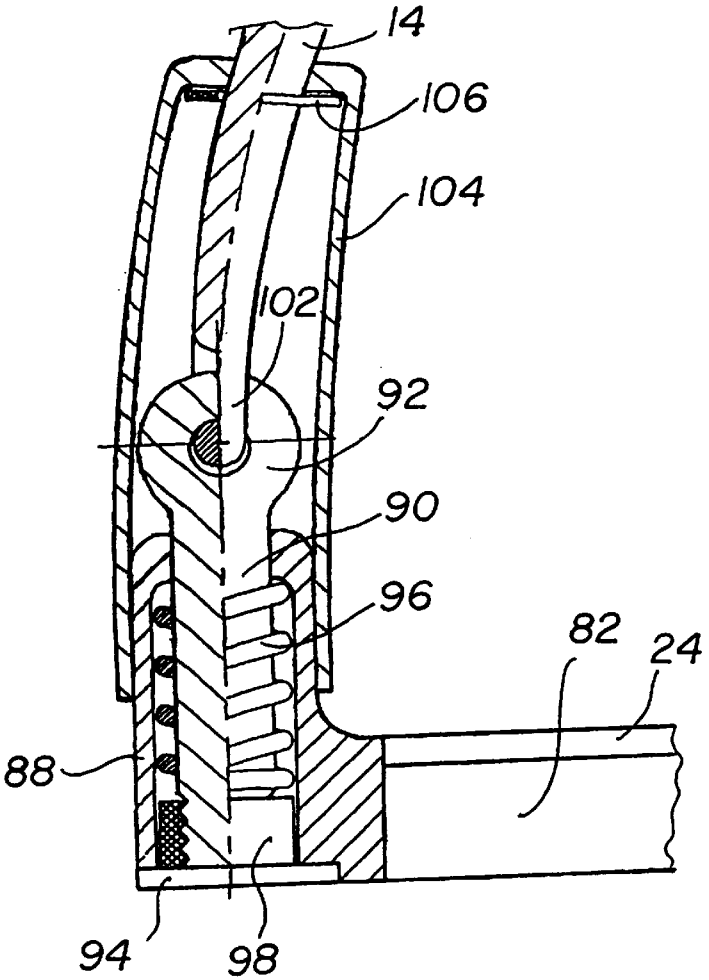
FIG. 9 is an enlarged, partially cut-out view showing the cylinder/plunger connection between the curved arms of the a carrier and the footrest in the embodiment of FIG. 7 in retracted position.

In another embodiment 80 of the invention, shown in FIGS. 7 and 8, the footrest 82 of the stirrup is not rotatably connected to the ends of the curved arms 14,16. Instead, the foot 82 includes two integral rigid ends 84 and 86 hinged to the arms 14,16 by means of interlocking links that provide flexibility to the footrest. As illustrated in the cut-out portion of the end 86 in FIG. 7, the footrest structure includes an integral cylindrical housing 88 containing a bolt or plunger 90 with a looped end 92 protruding upward therefrom. The housing 88 has an integral top end with a central perforation adapted to loosely receive the shank of the bolt 90; the bottom of the housing is open and covered by a cap 94. As also shown in greater detail in FIGS. 9 and 10, a spring 96 is loosely encased over the bolt 90 within the inner wall of the housing 88 and the threaded tip of the shank of the bolt is screwed onto a locking nut 98. Thus, the spring 96 contained between the top end of the housing 88 and the nut 98 urges the bolt 90 downward, in plunger fashion, such that the spring becomes compressed when downward pressure is exerted on the footrest 82, as illustrated by the arrows A1 in FIG. 8. The resulting extended position of the footrest 82 is illustrated in FIG. 10. An identical assembly is contained within the cylindrical housing 100 at the other end 84 of the footrest 82.

The loop 92 in the bolt 90 is coupled to a corresponding loop 102 on the bottom end of the arm 14, such as to provide a hinge point for the footrest assembly. The loop 92 is positioned on the same plane of the curved arms 14,16 of the carrier, while the loop 102 is disposed on a perpendicular plane to facilitate the footrest's swing motion back and forth. A resilient boot 104 with a snap-on retention ring 106 are provided to cover and protect the hinge assembly. An identical combination of components is provided for the hinge connection and within the cylindrical housing 100 at the other end 84 of the footrest 82.

Figure 11:
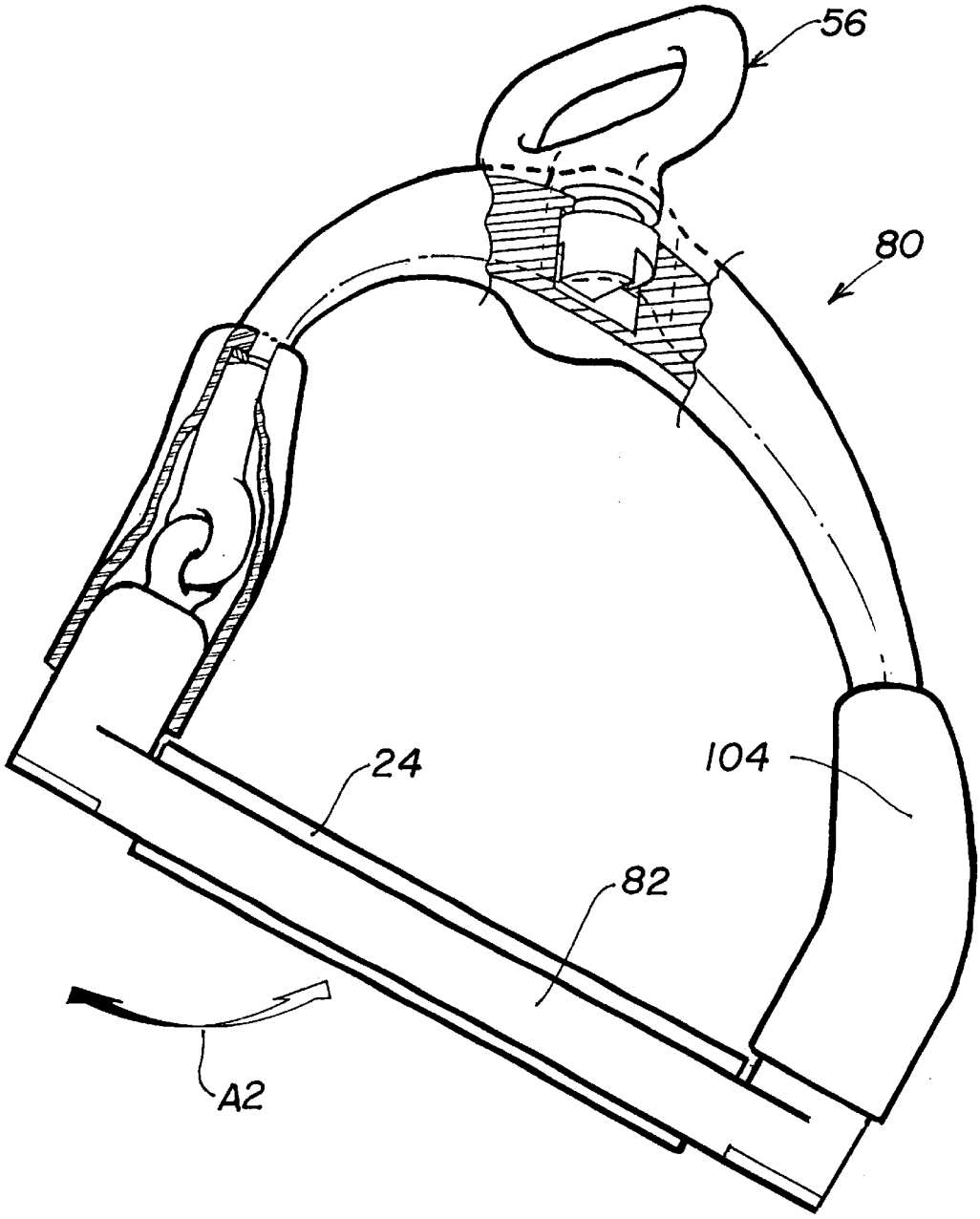
FIG. 11 is a perspective view of a stirrup of FIG. 7 illustrating the swinging motion of the footrest resulting from its hinged connection with the carrier of the stirrup.

As a result of this configuration, the footrest 82 is provided with back and forth motion and shock absorption that improves the stability of the rider's foot in the stirrup. The spring 90 is preferably selected such that it becomes fully compressed under a weight of about 30–40 kg, which is estimated to be optimal for shock absorption of the forces exerted on each stirrup by an average-size person during normal riding. In addition, because of the hinged connections and the resilient boots 104 placed over them, the footrest is sufficiently flexible, as illustrated by the arrow A2 in FIG. 11, to promote the release of the rider's foot in case of a fall. On the other hand, the boots ensure that the footrest is normally in a perpendicular position with respect to the carrier, which is desirable for stability and safety. When the rider's boot and footrest are bent forward, the spring-loaded arrangement tends to prevent separation of the rider's foot from the stirrup so long as pressure is applied, but separation is promoted by the spring reaction when pressure is no longer applied, which is desirable in case of a fall.

It is noted that the cylinder/plunger assemblies of the invention are easily taken apart for adjustment and repair, which is a desirable feature and advantage of this stirrup. The screw 98 can be screwed more or less to tighten or release the spring 90, thereby affecting its performance. Similarly, the spring can be replaced with one with different characteristics to suit a particular application.

The swiveled eye 56 in this embodiment of the invention is the same as described in FIGS. 5 and 6. The eye is mounted on the carrier above the housing 18 and serves to hold a strap from which the stirrup 80 is suspended on the animal to be ridden. The eye is rotatable relative to the carrier at least through an angle of about 90 degrees (see arrow A3 in FIG. 8) and, preferably, restricted to 90 degrees between the positions shown in FIGS. 7 and 8. The eye 56 can rotate freely or continuously relative to the carrier between the two terminal positions.

As would be obvious to those skilled in the art, the construction components of the connection assembly 64 for the eye 56 of the invention are a mirror image of each other for the left and right stirrups, so that both stirrups can be swiveled in and out in the same manner. Moreover, the stirrups of the invention can be used for a horse as well as for other animals which can be ridden.

Various modifications are possible within the meaning and range of equivalence of the appended claims. Therefore, while the invention has been shown and described in what is believed to be the most practical and preferred embodiments, it is recognized that departures can be made therefrom within the scope of the invention, which is not to be limited to the details disclosed herein but is to be accorded the full scope embraced by any and all equivalent apparatus.

I claim:

1. A shock-absorbed stirrup comprising:

a carrier defining a plane;

a holding member on said carrier for holding a strap;

a footrest joined to said carrier and having a support surface movable between an extended position and a retracted position in said plane;

resilient means for urging the support surface toward said retracted position;

a hinge connection between said carrier and footrest; and a resilient boot over said hinge connection.

2. The stirrup of claim 1, wherein said carrier is freely rotatable relative to said holding member at least through an angle equalling or approximating 90 degrees.

3. The stirrup of claim 1, wherein said carrier is rotatable relative to said holding member, said holding member having a holding portion which is at least approximately coplanar with said carrier in a predetermined position of said carrier; and further comprising means for limiting rotation of said carrier relative to said holding member, said limiting means including means for restricting rotation of said carrier out of said predetermined position to a single direction only.

4. The stirrup of claim 3, wherein said carrier and said footrest are freely rotatable relative to said holding member at least through an angle equalling or approximating 90 degrees.

5. The stirrup of claim 1, wherein said carrier is freely rotatable relative to said holding member at least through an angle equalling or approximating 90 degrees.

6. The stirrup of claim 1, wherein said carrier is rotatable relative to said holding member, said holding member having a holding portion which is at least approximately coplanar with said carrier in a predetermined position of said carrier; and further comprising means for limiting rotation of said carrier relative to said holding member, said limiting means including means for restricting rotation of said carrier out of said predetermined position to a single direction only.

7. The stirrup of claim 6, wherein said carrier and said footrest are freely rotatable relative to said holding member at least through an angle equalling or approximating 90 degrees.

8. A shock-absorbed stirrup comprising:

a carrier defining a plane;

a holding member on said carrier for holding a strap;

a footrest joined to said carrier and having a support surface movable between an extended position and a retracted position in said plane; said footrest comprising two ends, each end including a housing containing a plunger hinged to an arm of the carrier; and resilient means for urging the support surface toward said retracted position; said resilient means including a spring acting upon said plunger to urge the support surface toward said retracted position.

9. The stirrup of claim 8, further comprising a resilient boot over each of said hinge connections.

10. The stirrup of claim 8, wherein said carrier is freely rotatable relative to said holding member at least through an angle equalling or approximating 90 degrees.

11. The stirrup of claim 8, wherein said carrier is rotatable relative to said holding member, said holding member having a holding portion which is at least approximately coplanar with said carrier in a predetermined position of said carrier; and further comprising means for limiting rotation of said carrier relative to said holding member, said limiting means including means for restricting rotation of said carrier out of said predetermined position to a single direction only.

12. The stirrup of claim 11, wherein said carrier and said footrest are freely rotatable relative to said holding member at least through an angle equalling or approximating 90 degrees.

* * * * *